US005673444A

United States Patent [19]

Middendorf

[11] Patent Number: 5,673,444

[45] Date of Patent: Oct. 7, 1997

[54] SUSPENDED HAMMOCK

[75] Inventor: John Middendorf, Hurricane, Utah

[73] Assignee: The North Face, San Leandro, Calif.

[21] Appl. No.: 786,238

[22] Filed: Jan. 21, 1997

[51] Int. Cl.[6] ..... A45F 3/24

[52] U.S. Cl. ..... 5/127; 5/122; 5/120

[58] Field of Search ..... 5/120, 121, 122, 5/123, 127, 128, 130; 297/273, 279, 280

[56] References Cited

U.S. PATENT DOCUMENTS

| | | | |
|---|---|---|---|
| 273,756 | 3/1883 | Moore | 5/127 X |
| 842,698 | 1/1907 | Pillman | 5/123 X |
| 1,527,885 | 2/1925 | Lhota | 5/123 X |
| 1,527,886 | 2/1925 | Lhota | 5/123 X |
| 4,188,063 | 2/1980 | Dusart | 5/122 X |
| 4,221,429 | 9/1980 | Wade | 5/121 X |

*Primary Examiner*—Michael F. Trettel

[57] ABSTRACT

A suspended hammock for mountaineering is provided for suspending a climber adjacent a substantially vertical face of a mountain. The hammock includes a supporting membrane which forms a bed of a size to support the climber in a substantially prone position, and a 'T'-shaped supporting frame to which the bed is attached by a plurality of suspension straps. The straps are positioned along the edges of the bed, with one strap being positioned at each side of the head end, two straps being positioned on each side in the middle, and a fourth strap being positioned on each side at the foot end of the bed. The straps can be adjusted in length by means of a buckle. The 'T'-frame comprises a spreader bar and a cross bar, with the spreader bar being attached to the cross bar at it's midpoint. The suspension straps are attached in a spaced relationship to the first and second ends of the spreader bar. The 'T'-frame in turn is attached to the mountain face by a set of 'T'-frame suspension straps attached to the extreme ends of the cross bar and the first end of the spreader bar. One of the 'T'-frame suspension straps can be made adjustable in length. The use of the suspended hammock reduces thermal exchange between the climber and the mountain environment while resting.

7 Claims, 3 Drawing Sheets

SUSPENDED HAMMOCK

BACKGROUND OF THE INVENTION

1. Field of the Invention

This invention relates to a hanging hammock that has a bed suspended from above using a plurality of suspension straps attached at various places along the edge of the bed at one end and drawn together at two or more points at the other end and then attached to a 'T' shaped rigid frame. The 'T' frame, in turn is secured to a cliff or vertical mountain face in a manner such that the user is suspended above the ground. The invention is used as a bed by a human user while bivouacking on the side of a cliff or vertical face of a mountain.

2. Background Information

For years climbers have been using a variety of hammock designs to hang suspended above the valley floors while climbing 'Big Walls' in the great mountain ranges throughout the world. The walls would take several days, if not weeks to climb, and, consequently, climbers would require a place to sleep. The climbers turned to the hammock design to provide for such beds, despite the serious problems and deficiencies they had.

The primary deficiency of the hammock design was two fold. First, the original hammock design had two suspension points, one at either end. This design bunched the climber up in the bed because of the sag of his weight in the middle of the bed and because the bed was designed to be linear, not having width. Thus, the climber would have difficulty eating and preparing gear for the next days climb, not to mention an uncomfortable night's sleep due to the lack of back support.

Second, the design did not have any insulation beneath or along the sides of the climber. The bed was made of a durable piece of nylon. Thus, there was great thermodynamic exchange and the climber would become cold quickly. This limited the hammock design to summer situations at lower altitudes.

This defect would be exaggerated when the climber would be sleeping against a mountainside on one side. The rock would act as a heat sink and drain the climber of his warmth and thus his available energy to climb. In the worst conditions, rain flowing down the rock would dampen the climber and create a hypothermic condition.

These serious design deficiencies led to the uses of 'Portaledges' by climbers. Portaledges are rectangular cots with a ridged frame suspended from above. Portaledges solved the hammock problems by creating a somewhat ridged two dimensional bed for the climber to sleep on and by using the frame of the Portaledge to position the climber away from the mountainside. The primary problem with the Portaledge is that they are somewhat heavy and bulky.

It can seen that there is a need for a hammock which provides the mountaineer with a more convertible bed system while reducing thermodynamic exchange between the climber and the mountain environment. This design would ideally be lighter and less bulky than a Portaledge to provide the climber with alternative sleeping system other than the Portaledge.

SUMMARY OF THE INVENTION

The present invention is a hanging hammock for suspending a climber adjacent a substantially vertical face of a mountain. The device comprises a sheeting of durable membrane, a bed, of a size to enable a climber to be fully supported on it when the climber is in a prone position.

The device comprises a plurality of suspension straps positioned along the bed to enable the climber to maintain a substantially prone position when being supported by the bed. Generally, there are four on each side of the bed, one strap positioned near the head of the bed, two in the middle of the bed, and one near the foot of the bed. These straps usually have an adjustment means to allow the user to adjust the length of each strap for comfort and position. The straps on each side are further drawn together at two (or more points) of suspension and attached to a 'T' frame.

The 'T' frame of the present invention comprises a spreader bar and a cross bar, the spreader bar having first and second ends and attachment means to receive the suspension straps. The second end of the spreader bar intersects substantially at the mid-point of the extreme ends of the 'T' frame's cross bar. The 'T' frame is further characterized wherein the spreader bar is positioned orthogonally to the vertical face of the mountain when supporting the bed and the cross bar is positioned parallel to the vertical face when supporting the bed.

The bed suspension straps are attached in a spaced apart relationship to the first and second ends of the spreader bar. In turn, the 'T ' frame is supported by the vertical wall by connecting at least the extreme ends of the cross bar as well as the first end of the spreader bar by 'T' frame suspension straps to the vertical face.

The 'T' frame suspension straps are most often drawn to a single point, but they may be also made to attach independently. Often, one of the 'T' frame suspension straps is adjustable. The ability to adjust these straps, as well as the bed suspension straps, may allow the climber to prevent himself from rolling out of the bed easily because of unequal and various positioning of the climber while on top of the bed.

Thus, the object of the invention is to provide a suspended hammock that has increased comfort while reducing the thermodynamic exchange between the climber and the surrounding mountain environment.

The invention accomplishes these objects and solves the problems and shortcomings of the prior art in an inexpensive and simple manner. The present invention represents a significant improvement over the prior art in the following ways.

First, the present invention has a plurality of suspension points, which creates a wider and firmer bed. This is accomplished by having plurality of adjustable suspension straps on each side of the bed to support the climber. This is further accomplished by suspending the bed by the 'T' frame which acts as a spreader bar keeping the walls of the nylon bed from wrapping around the climber as in a conventional hammock.

Second, the invention significantly reduces the thermodynamic exchange between the climber and the vertical face. When the prior art was in use, the climber would be positioned alongside of the vertical face because the two anchor points would be positioned in the same plane in which the climber was sleeping. The climber would therefore be forced along side the rock, which is a heat sink. By suspending the climber from above by two separated suspension points, rather than horizontally at either end, and having the 'T' frame lean against the vertical face, the climber is separated from the heat sink. The result is that the climber may stay warmer and dryer.

As can be seen, the present invention provides not only increased comfort, but also increased weather protection for the mountaineer.

BRIEF DESCRIPTION OF THE DRAWINGS

For a further understanding of the nature and objects of the invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
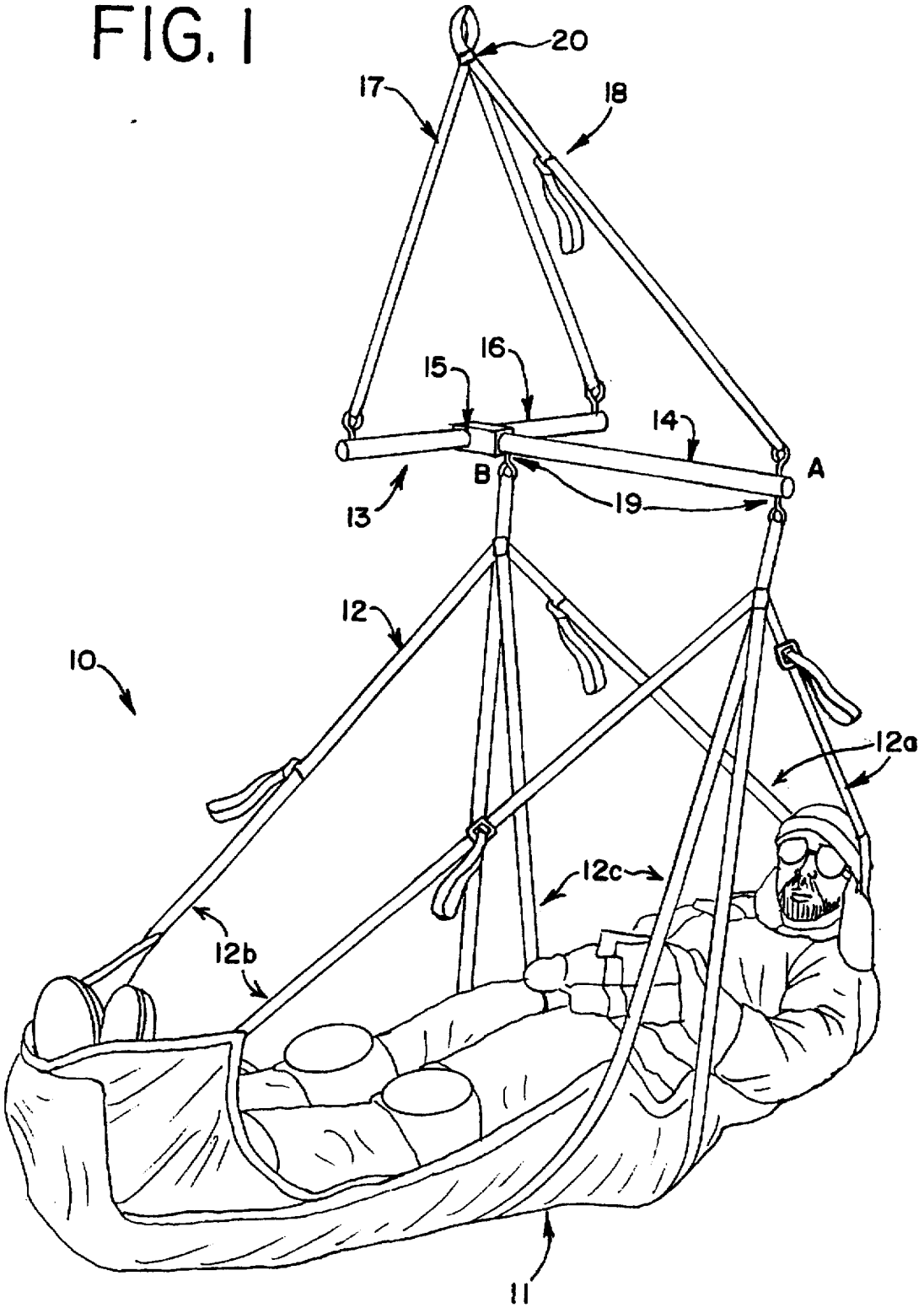
FIG. 1 illustrates a side view of the preferred embodiment of the suspended hammock as shown during operation.

FIG. 1 best illustrates the preferred embodiment of the present invention designated generally by the number 10. In FIG. 1 there can be seen a suspended hammock 10 having a bed of durable membrane 11, generally made of nylon, of a size to enable a climber to be fully supported on it when the climber is in the prone position.

The device comprises a plurality of suspension straps 12 along the bed 11, usually eight. The straps 12 are positioned to support the climber's head 12*a*, the feet 12*b*, and pelvic area 12*c* on each side of the bed 11. The straps 12 are sewn into the side of the bed 11, but may be secured by other attachment means. The straps 12 may be adjustable to allow the climber to adjust his overall position and recline while using the device.

The 'T' frame 13, the primary object of the invention, consists of a spreader bar 14 having a first end A, a second end B, and an attachment means to receive the straps 12 and a cross bar 16 having an attachment means to receive the second end B, generally a reinforced hole 15. The second end B intersects substantially at the mid-point of the extreme ends of the cross bar 16. The 'T' frame 13 is further characterized wherein the spreader bar 14 is positioned orthogonally to the vertical face when supporting the bed 11 and the cross bar 16 is positioned parallel to the vertical face when supporting the bed 11. When thus assembled, the resulting 'T' frame 13 is made for suspending the hammock 10.

The suspension straps 12 are attached in a spaced apart relationship to the first end A and second end B of the 'T' frame 13. Four suspension straps 12*a*, *b*, and *c* on each side of the bed 11 are drawn to a single point 19 and attached to the spreader bar 14 at or near ends A and B of the spreader bar 14. The distance between the two points of suspension 19 is usually equal to the width of a climber's shoulders. This spacing allows the climber to hang directly below the 'T' frame 13 and generally away from the vertical face. The straps 12 may be adjustable to allow the user to adjust the recline and overall position of the user.

The 'T' frame 13 is supported by the vertical wall by connecting at least the extreme ends of the cross bar 16 as well as the first end A of the spreader bar 14 by 'T' frame suspension straps 17, one of which is adjustable 18. The straps 17 are drawn to a single point 20 and attached to the mountainside by an attachment means. The most efficient attachment means is constructed by having the straps 12 sewn into a back-sewn loop and then feeding the loop through a locking carabiner, which, in turn, is attached to a piton, camming unit, or bolt fixed to the vertical face.

Figure 2:
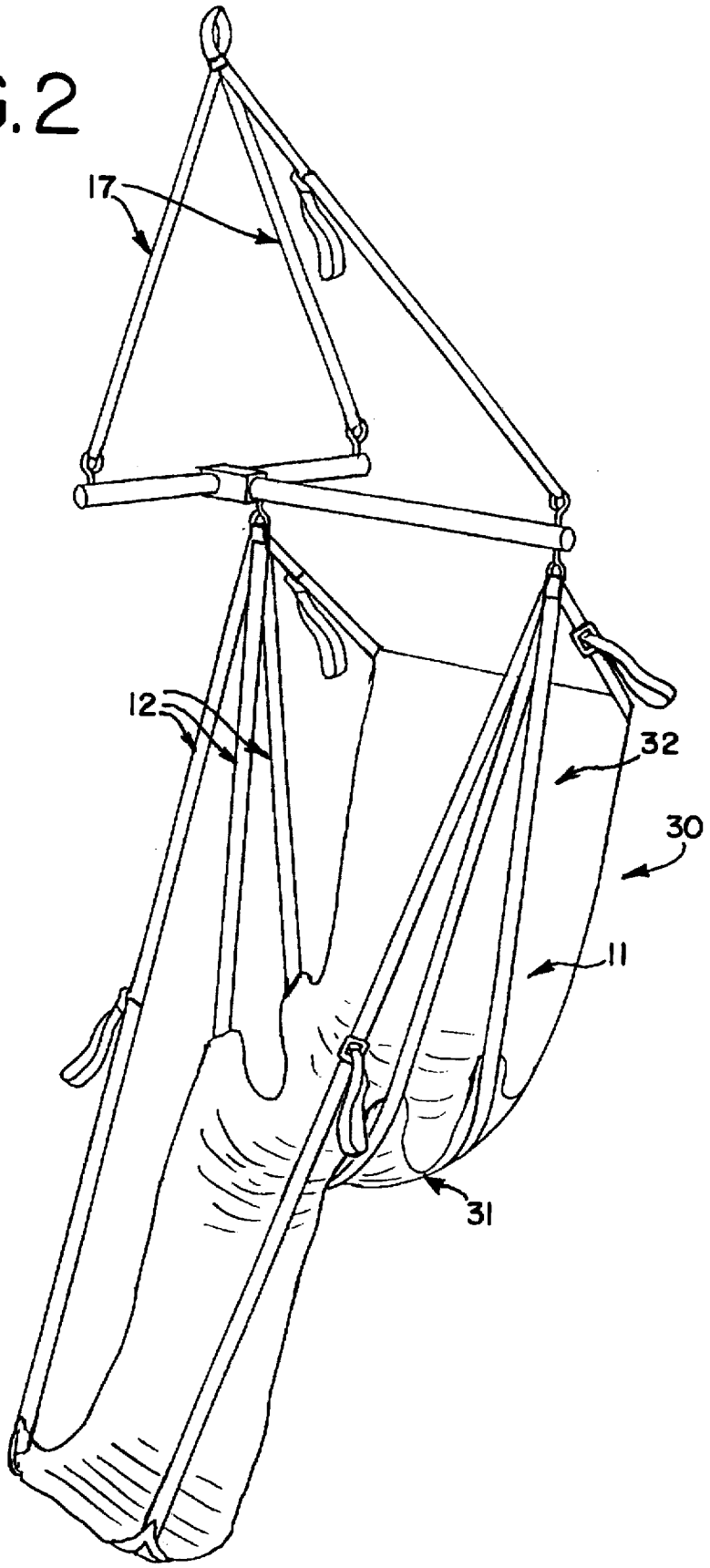
FIG. 2 illustrates the side view of the present invention adjusted for use as a suspended chair.

FIG. 2 best illustrates the preferred embodiment of the present invention in use as a chair 30. The shape of the nylon bed 11 has been shortened, and may be cut ergodynamically, so that the resulting shape has a seat 31 and a back 32. The straps 12 and 'T' frame suspension straps 17 are essentially the same as the hammock 10, except the suspension straps at the climber's feet 12*b* are longer.

Figure 3:
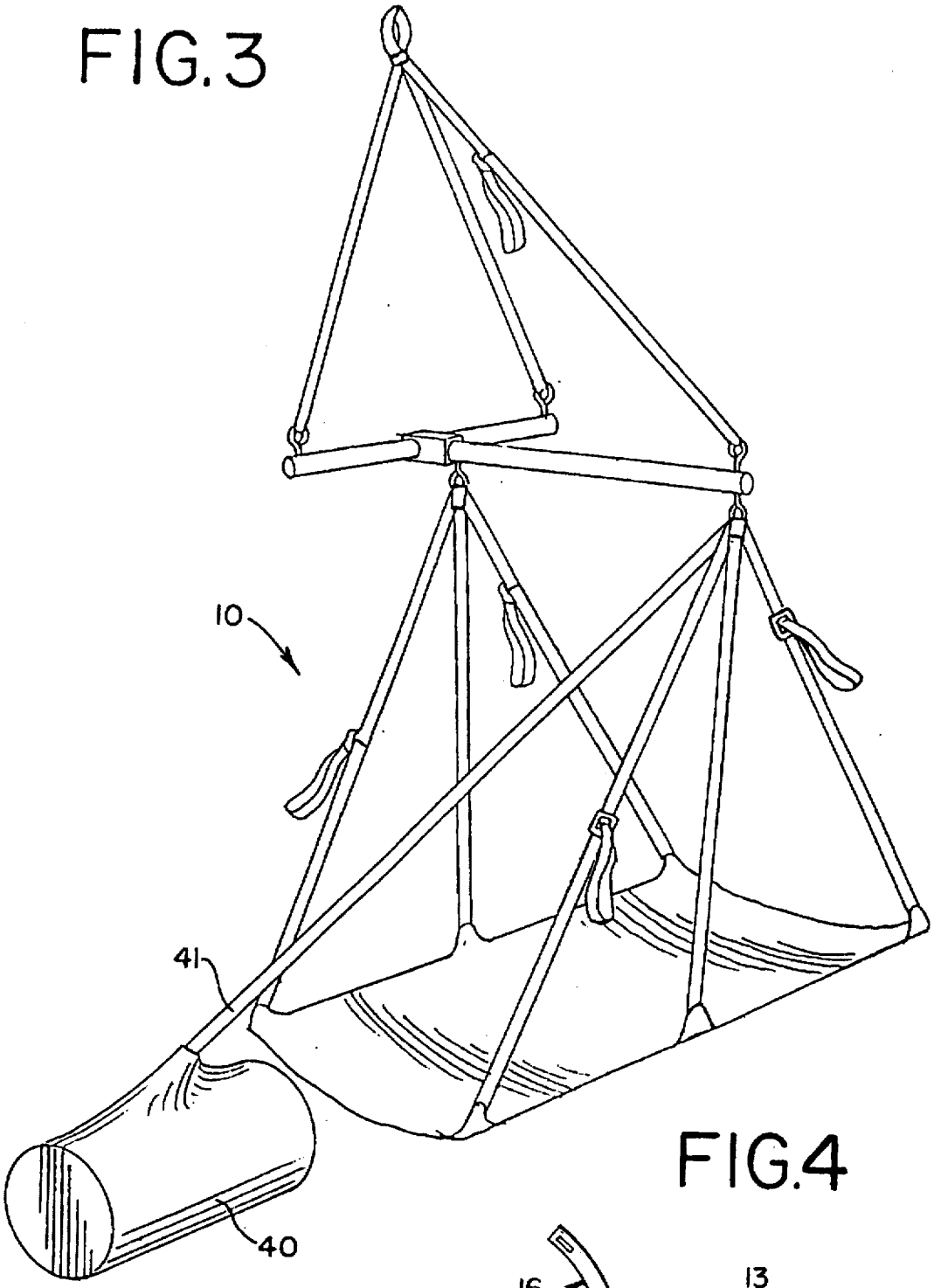
FIG. 3 illustrates the side view of the present invention having an optional foot bag.

FIG. 3 best illustrates the hammock 10 with the addition of a foot bag 40 having at least one suspension strap 41 attached. The foot bag 40 allows the climber increased movement and position when in use as a chair. The foot bag 40 essentially acts as an ottoman.

Figure 4:
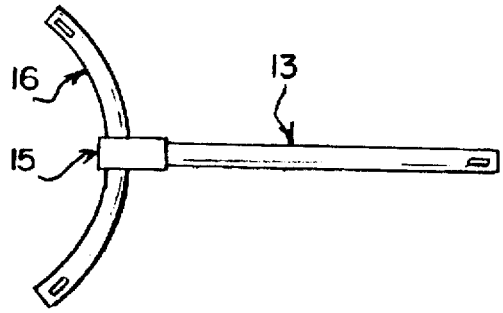
FIG. 4 illustrates the top view of the 'T' frame having a curve.

Lastly, the shape of the 'T' frame 13 may vary according to different uses. For example, FIG. 4 shows a curved cross bar 50 for hanging along side the mink of a tree.

It should now be apparent that the invention described above possesses all of the attributes set forth in the Specification under the heading 'Summary of the Invention'. Because the invention can be modified to some extent without departing from its principles and intent, the present invention should be understood as encompassing all modifications within the spirit and scope of the following claims.

What I claim is:

1. A devise for suspending a climber adjacent a substantially vertical face of a mountain, the device comprising a bed of durable membrane of a size to enable a climber to be fully supported thereon when the climber is in a prone position, the device further comprising a plurality of bed suspension straps positioned along the bed to enable the climber to maintain a substantially prone position when being supported by the bed, the bed suspension straps being further attached to a 'T' frame, the 'T' frame comprising a spreader-bar and a cross-bar, the spreader bar having a first and second ends, the second end of the spreader bar intersecting substantially at the midpoint of the cross bar, the 'T' frame being further characterized wherein the spreader-bar is positioned orthogonally to the vertical face when supporting the bed and the cross bar being positioned parallel to the vertical face when supporting the bed, the bed suspension straps being attached in a spaced apart relationship to the first and second ends of the spreader bar of the 'T' frame and the 'T' frame being supported by the vertical wall by connecting at least the extreme ends of the cross bar as well as the first end of the spreader bar of the 'T' frame by top suspension straps to the vertical face.

2. The device of claim 1 wherein at least eight adjustable bed suspension straps are employed to maintain the bed in a substantially horizontal orientation when supporting a climber.

3. The device of claim 2 wherein at least two suspension straps are connected to the bed at one end thereof for supporting a climber's head, at least two suspension straps are connected to the bed at a second end thereof for supporting a climber's feet and at least four suspension straps are connected proximate the mid-point of the bed between the ends of the bed to support the pelvic area of the climber.

4. The device of claim 1 wherein the bed suspension straps are attached to the 'T' frame such that when the bed is employed to support a climber, neither the climber nor the bed touch the vertical wall when at rest.

5. The device of claim 1 wherein the bed is comprised of nylon.

6. The devise of claim 1 wherein an additional foot bag having, and being suspended by, at least one suspension strap to receive the feet of the climber.

7. The devise of claim 1 wherein the cross bar has a curved shape.

* * * * *